US009089889B2

(12) United States Patent
Kohnen

(10) Patent No.: US 9,089,889 B2
(45) Date of Patent: Jul. 28, 2015

(54) DEVICE FOR FLANGING THE END OF A METAL TUBE

(75) Inventor: Wolfgang Kohnen, Hannover (DE)

(73) Assignee: Alcatel Lucent, Boulogne-Billancourt (FR)

( * ) Notice: Subject to any disclaimer, the term of this patent is extended or adjusted under 35 U.S.C. 154(b) by 0 days.

(21) Appl. No.: 14/117,683

(22) PCT Filed: Mar. 15, 2012

(86) PCT No.: PCT/EP2012/054555

§ 371 (c)(1),
(2), (4) Date: Nov. 14, 2013

(87) PCT Pub. No.: WO2012/156118

PCT Pub. Date: Nov. 22, 2012

(65) Prior Publication Data

US 2014/0076017 A1 Mar. 20, 2014

(30) Foreign Application Priority Data

May 16, 2011 (EP) ..... 11290229

(51) Int. Cl.
*B21D 19/16* (2006.01)
*B21D 41/02* (2006.01)
(Continued)

(52) U.S. Cl.
CPC ..... *B21D 19/046* (2013.01); *B21D 19/02* (2013.01)

(58) Field of Classification Search
CPC ..... B21D 19/046; B21D 19/02
USPC ..... 72/120, 367.1, 370.1, 370.03, 370.11
See application file for complete search history.

(56) References Cited

U.S. PATENT DOCUMENTS 2,575,938 A * 11/1951 Brenneke ..... 72/75
3,451,243 A * 6/1969 Gallinger ..... 72/370.11
(Continued)

FOREIGN PATENT DOCUMENTS

CN 2782252 5/2006
CN 102357579 2/2012
(Continued)

OTHER PUBLICATIONS

International Search Report for PCT/EP2012/054555 dated May 10, 2012.
(Continued)

*Primary Examiner* — David B Jones
(74) *Attorney, Agent, or Firm* — Fay Sharpe LLP

(57) ABSTRACT

The invention refers to a device (11) for flanging the end (13) of a metal tube (13) to achieve a circumferential surface extending outward at right angles from the tube (13), comprising a flanging tool (17) adapted to be attached to the end of the tube (13), the flanging tool (17) having a guiding arrangement (31) drivable by a shaft (33, 48) of the guiding arrangement (31) and a pressure element (27) attached to the guiding arrangement (31), the guiding arrangement (31) comprising shifting means (35) driven by the rotating (89) shaft (33, 48) for shifting the pressure element (27) in an outward radial direction (37) with respect to the tube (13). In order to prevent the device (11) from being damaged if a torque applied to the shaft (33, 48) is not limited, it is suggested that the shifting means (35) be arranged for stopping shifting the pressure element (27) if a radial end position of the pressure element (27) is reached and permitting the rotation (89) of the shaft (33, 48) when the end position is reached.

14 Claims, 3 Drawing Sheets

(51) Int. Cl.
*B21D 19/04* (2006.01)
*B21D 19/02* (2006.01)

(56) References Cited

U.S. PATENT DOCUMENTS

| | | | |
|---|---|---|---|
| 4,905,492 | A | 3/1990 | Lobakk |
| 5,477,720 | A | 12/1995 | Lentz et al. |
| 5,826,454 | A | 10/1998 | Kohnen |
| 7,257,975 | B1 | 8/2007 | Stauffacher et al. |
| 2007/0104598 | A1 | 5/2007 | Varennes et al. |

FOREIGN PATENT DOCUMENTS

| | | | |
|---|---|---|---|
| DE | 38 05 814 | A1 | 9/1988 |
| JP | S53-155538 | | 12/1978 |
| JP | H05-33921 | | 5/1993 |
| JP | H 08197148 | | 8/1996 |

OTHER PUBLICATIONS

Japan Office Action dated Sep. 9, 2014 (translation attached).
Korean Office Action dated Dec. 29, 2014 (translation unavailable).

* cited by examiner

DEVICE FOR FLANGING THE END OF A METAL TUBE

FIELD OF THE INVENTION

The present invention refers to a device for flanging the end of a metal tube to achieve a circumferential surface extending outward at right angles from the tube.

BACKGROUND

A device for flanging the end of a metal tube is known in the art. This device has a mechanism for moving a pressure element having a flanging pin in a radial direction with respect to the tube. This mechanism is driven by rotating a rod. If the radial movement reaches an end position then the rotation of the rod is blocked. When applying a high torque on the rod when the end position has been reached, the known device may be damaged.

SUMMARY

The object of the present invention consists in providing a device for flanging the end of a metal tube that is not damaged when a torque applied to a driving shaft of the device is not limited and that can be inexpensively manufactured.

According to an embodiment, a device for flanging the end of a metal tube to achieve a circumferential surface extending outward at right angles from the tube is provided, the device comprising a flanging tool adapted to be attached to the end of the tube, the flanging tool having a guiding arrangement drivable by a driving shaft of the guiding arrangement and a pressure element attached to the guiding arrangement, the guiding arrangement comprising shifting means driven by the rotating drive shaft for shifting the pressure element in an outward radial direction with respect to the tube, wherein the shifting means are arranged for stopping shifting the pressure element if a radial end position of the pressure element is reached and permitting the rotation of the driving shaft when the end position is reached. Preferably, the guiding arrangement is configured for guiding the pressure element along a helical path when driven via a drive shaft.

In an embodiment, the shifting means comprise a cam gear arranged for stopping shifting the pressure element if a radial end position of the pressure element is reached and permitting the rotation of the driving shaft when the stop position is reached.

The shifting means of the device to not block the rotation of the driving shaft when the radial end position of the pressure element has been reached. As a consequence, the driving shaft may continue rotating after a flanging operation has been completed and driving the driving shaft without limiting a maximum torque at the driving shaft cannot damage the device. Therefore, the device can be driven by rather simple electric drives such as a cordless screwdriver. Moreover, when driving the driving shaft manually, no care must be taken of stopping rotating the driving shaft when the radial end position has been reached in order to avoid damaging the device.

In an embodiment, the shifting means comprise a cam gear having a first guiding wheel that comprises a guiding groove, the pressure element engaging with the guiding groove for shifting the pressure element in the radial direction. The gear cam translates the rotation of the driving shaft and/or the first guiding wheel into the radial movement of the pressure element. The guiding groove can easily be adapted so that radially shifting the pressure element is stopped when the end position has been reached without breaking or blocking the driving shaft and/or the first guiding wheel.

Preferably, the guiding groove comprises an outer circular section surrounding an inner helical section of the guiding groove. When the pressure element engages with the inner helical section, it is shifted in the outward radial direction until it engages with the outer circular section where it reaches its radial end position. After having engaged with the circular section, the pressure element is not shifted in the radial direction any more. However, both the driving shaft as well as the first guiding wheel can still rotate and are not blocked because the pressure element has reached the end position.

In a preferred embodiment, the pressure element has a guiding pin extending into the guiding groove so that the pressure element engages with the guiding groove. In other words, the guiding groove moves the pressure element in the radial direction until the end position is reached.

In an embodiment, the guiding arrangement comprises rotation means configured for moving the pressure element in a tangential direction with respect to the tube, simultaneous shifting the pressure element in the radial direction and moving the pressure element in the tangential direction resulting in a helical movement of the pressure element.

Preferably, the rotation means comprise a second guiding wheel having a radial slot in which the pressure element is supported shiftable in the radial direction with respect to the tube, rotating the second guiding wheel resulting in the movement of the pressure element in the tangential direction.

According to an embodiment, the two guiding wheels are rotatable around a common centre axis and the guiding arrangement comprises a transmission for driving the guiding wheels via the driving shaft such that the rotational speeds of the two wheels differ from each other. The rotational speeds being different with respect to each other makes the pressure element and/or the guiding pin moving in a lateral direction within the guiding groove. Because the pressure element and/or the guiding pin is moved within the guiding groove the pressure element is shifted in the radial direction.

In an embodiment, the rotational speed of the first guiding wheel is greater than the rotational speed of the second guiding wheel when the driving shaft is rotating. In another embodiment, the rotational speed of the first guiding element is less than the rotational speed of the second guiding wheel when the driving shaft is rotating.

In an embodiment, the first guiding wheel and/or the second guiding wheel comprises a gear wheel. The gear wheel may be part of a transmission of the guiding arrangement.

A compact, in particular flat, device can be obtained if a centre axis of the driving shaft is located spaced apart from the centre axis of the guiding wheels and running in parallel to the centre axis of the guiding wheels and/or wherein the driving shaft has a first driving gear for driving the first guiding wheel and a second driving gear for driving the second guiding wheel.

In a preferred embodiment, the transmission has a first intermediate gear located between the first driving gear and the first guiding wheel and/or a second intermediate gear located between the second driving gear and the second guiding wheel.

In an embodiment, the flanging tool has a preferably detachable crank handle that can be attached to a shaft of the device for manually driving the guiding arrangement, preferably to a further shaft of the device, a transmission ratio between the further shaft and the first guiding wheel and/or the second guiding wheel being less than a transmission ratio between the driving shaft and the first guiding wheel and/or the second guiding wheel. Applying a low transmission ratio between the further shaft and the first guiding wheel and/or the second guiding wheel eases manual operation of the device because only few manual rotations of the further shaft are required to flange the end of the tube.

Preferably, the further shaft is torque-proof connected with one of the guiding wheels, preferably, the first guiding wheel. The axis of the first guiding wheel and/or the second guiding wheel may correspond to a center axis of the further shaft. In this case, the transmission ratio between the further shaft and the corresponding guiding wheel is 1. The transmission ratio between the driving shaft and each guiding wheel is greater than 1 in order to allow to drive the device e.g. electrically with rather high rotational speed and rather low torque.

In another embodiment, driving shaft has coupling means for coupling an electrical drive, preferably an electric screwdriver, with the driving shaft for electrically driving the guiding arrangement.

In yet another embodiment, the driving shaft can alternatively be driven by the detachable crank-handle or the electrical drive.

In order to be able to attach the device to the tube, in an embodiment the flanging tool has fastening means, said fastening means preferably comprising a flange, configured for fastening the flanging tool to a clamping body that is fixed on the tube.

According to a preferred embodiment of the present invention, it is suggested to use the device described herein for flanging the end of a metal tube to achieve a circumferential surface extending outward at right angles from the tube.

BRIEF DESCRIPTION OF THE FIGURES

Preferred embodiments and further advantages of the present invention are shown in the Figures and described in detail herein after.

DESCRIPTION OF THE EMBODIMENTS

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

Figure 1:
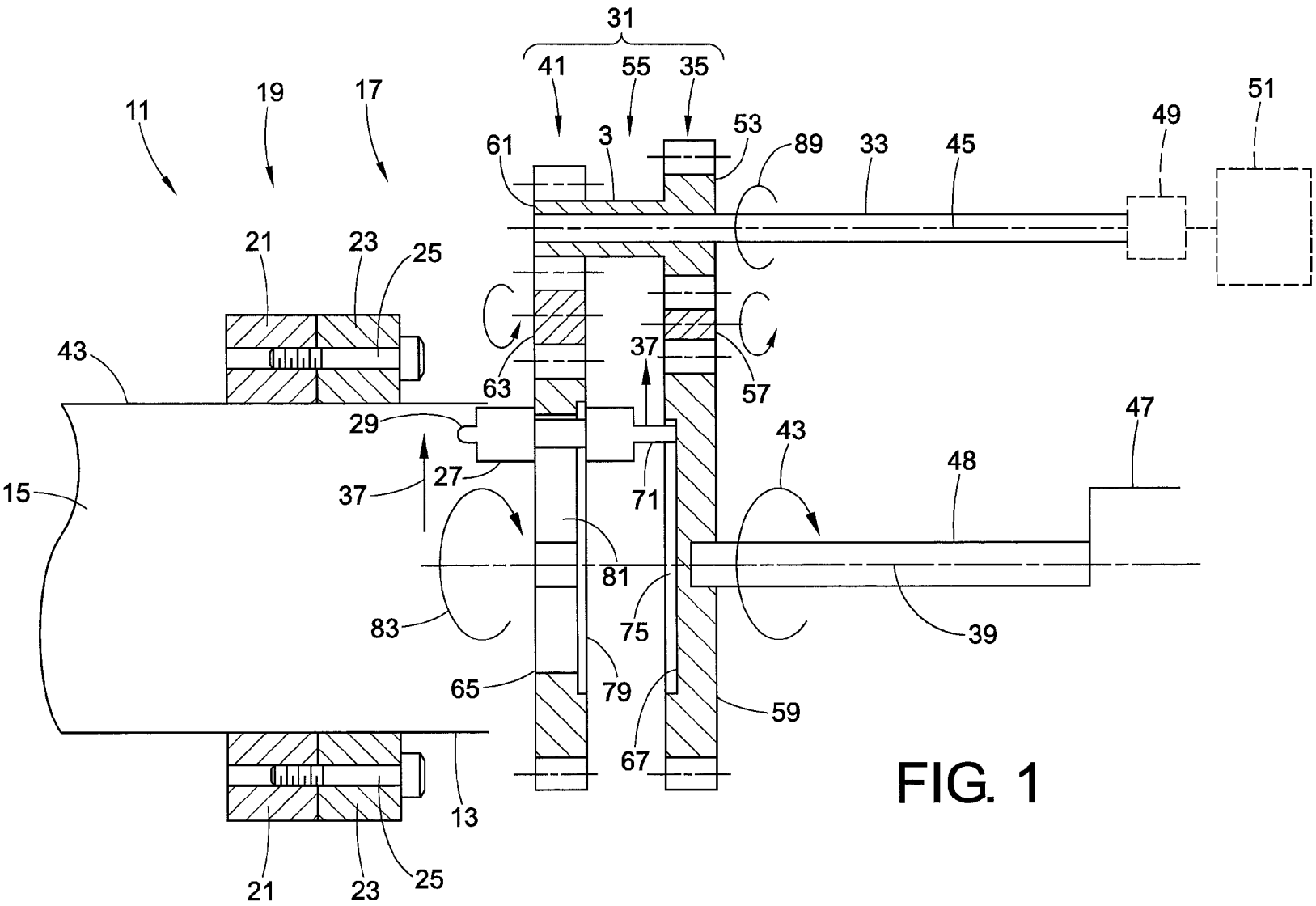
FIG. 1 shows a side view of a device for flanging the end of a metal tube.

FIG. 1 shows a device 11 for flanging the end 13 of a metal tube 15 to achieve a circumferential surface extending outward at least essentially right angles from the tube 15. This device 11 may be used for hollow conductors to the end of which plugs of fittings or other continue in hollow conductors will be attached. The surface formed by the flanged edge is not only used to mechanically secure fastening elements, but also as an electric contact surface. However, in principle such a surface can be used on all metal tubes whose ends must have a circumferential surface extending at right angles. It is unimportant whether a tube to be processed is smooth or corrugated in the transverse direction. Nor does the cross section of the tube, be it circular or elliptical, have any significance for the use of the device. However, the exemplary embodiment shown in FIG. 1 is adapted for the use in connection with the tube 15 having a circular cross section.

The device 11 comprises a flanging tool 17 and a clamping body 19. A clamping element 21 of the clamping body 19 is fixed to the tube 15 and the clamping body 19 is attached to fastening means 23 of the flanging tool 17. In the shown embodiment the fastening means 23 have a flange 25 for fastening the flanging tool 17 to a clamping body 19. The flanging tool 17 has a pressure element 27 comprising a flanging pin 29. A guiding arrangement 31 of the flanging tool 17 is configured for guiding the pressure element 27 along a helical path if the guiding arrangement 31 is driven by rotating a driving shaft 33.

The guiding arrangement has shifting means arranged for shifting the pressure element 27 in a radial direction (arrow 37), i.e. a direction 37 orthogonal to a centre axis 39 of the tube 15.

Furthermore, the guiding arrangement 31 has rotation means 41 adapted for moving the pressure element 27 around the centre axis 39, i.e. moving the pressure element 27 in a tangential direction (arrow 83). If the guiding arrangement 31 is shifting the pressure element 27 in the radial direction 37 and moving the pressure element 27 in the tangential direction 83 simultaneously then the pressure element 27 moves along a helical path starting in an inner region of the tube 15 and ending in a region beyond a side surface 43 of the tube 15. If the flanging pin 29 moves in the radial direction 37 beyond the inner region of the tube 15 while rotating, the end 13 of the tube 15 is bent outward resulting in the end 13 of the tube 15 being flanged.

For driving the guiding arrangement 31 the driving shaft 33 may be rotated about its central axis 45. The flanging tool 17 has a crank-handle 47 attached to the a further shaft 48 attached torque-proof to the first guiding wheel 59 so that the first guiding wheel 59 is rotated manually and drives the driving shaft 33. The axis 39 corresponds to a centre axis of the further shaft 48. In the shown embodiment, the crank-handle 47 can be removed from the further shaft 48 and coupling means 49 may be attached to the driving shaft 33. The coupling means 49 are configured for being coupled with an electrical drive such as a cordless screwdriver 51, a power drill or the like.

For manual operation by the crank-handle 47, the first guiding wheel 59 engages with a first intermediate gear 57. The first intermediate gear 57 engages with the driving gear 53 of a transmission 55. For motor driven operation at the driving shaft 33 a first driving gear 53 engages with the intermediate gear 57 that engages with a first gear of a guiding wheel 59 of the shifting means 35. Furthermore, a second driving gear 61 is arranged at the driving shaft 33 and engages with a second intermediate gear 63 that in turn engages with a gear of a second guiding wheel 65 of the rotation means 41.

As can be seen on FIG. 1, the driving shaft axis 45 is the rotation axis of the first driving gear 53 and the second driving gear 61. The centre axis 39 of the tube 15 corresponds to the rotating axis of both the first guiding wheel 59 and the second guiding wheel 65. However, the intermediate gears 57, 63 have different rotation axis.

Figure 2:
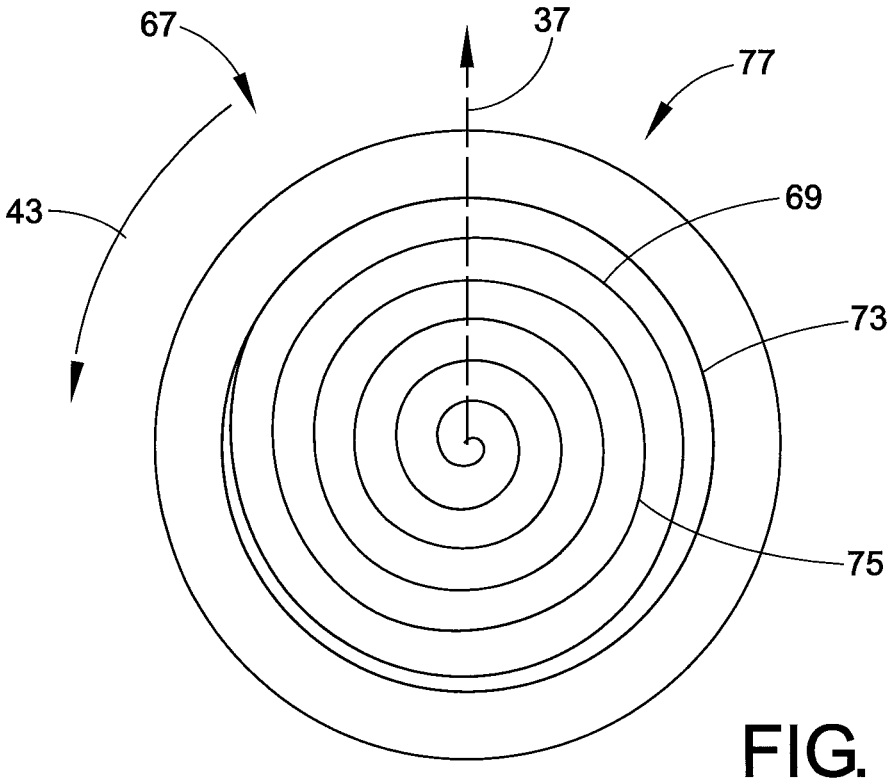
FIG. 2 shows a first guiding wheel of the device shown in FIG. 1.

FIG. 2 shows a view on a first surface 67 of the first guiding wheel 59 facing the pressure element 27. The first surface 67 has a guiding groove 69, with a guiding pin 71 of the pressure element 27 extending into the guiding groove 69 such that the pressure element 27 engages with the guiding groove 69. The guiding groove 69 has an outer circular section 73 surrounding an inner helical section 75. The first surface 67 including the guiding groove 69 and the guiding pin 71 are part of a cam gear 77 configured for translating the rotation 43 of the first guiding wheel 59 into a movement of the pressure element 27 in the radial direction 37.

In one embodiment, the first guiding wheel 59 comprises the gear that engages with the first intermediate guiding wheel 57 and a separate part in the form of a plate attached to the gear. This plate comprises the guiding groove 69. In this embodiment the gear may be made of plastic material and/or the plate may be made of a metal. In another embodiment, the guiding groove 69 is formed directly into a surface of the gear.

Figure 3:
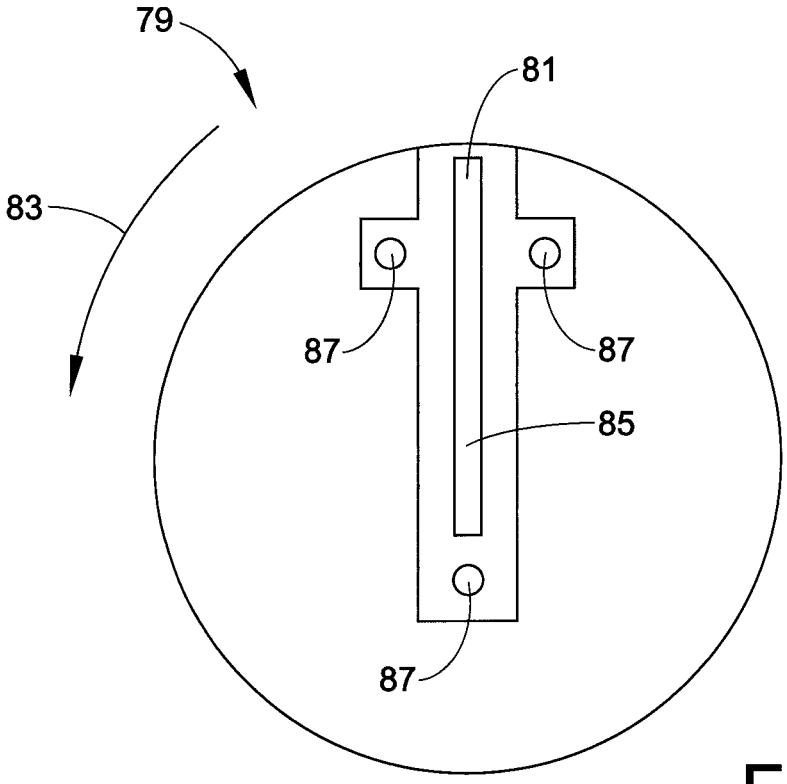
FIG. 3 shows a second guiding wheel of the device shown in FIG. 1.

FIG. 3 shows a second surface 79 of the second guiding wheel 65, the second surface 79 facing the first surface 67 of the first guiding wheel 65. As can be seen in FIG. 3, the second guiding wheel has a radial slot 81, within which the pressure element 27 extents, so that it can be moved in the radial direction 37 but not in a tangential direction with respect to the centre axis 39 and relative to the second guiding wheel 65. Rotation (arrow 83) of the second guiding wheel 65 makes the pressure element 27 rotating around the centre axis 39. In the shown embodiment, the second guiding wheel 65 comprises the gear that engages with a second intermediate gear 63. The gear of the second guiding wheel 65 may be made of plastic material. In order to reduce abrasive wear of the plastic material of the gear the radial slot 81 may be surrounded by an enforcement element 85 that can be made of metal or a different material and may be fixed on the gear with screws 87.

When operating the device 11 manually, the driving shaft 39 is rotated (arrow 43) and the guiding wheel 59 makes rotating the driving shaft 33. The transmission 55 is adapted to rotate the first guiding wheel 59 and the second guiding wheel 65 with different rotational speeds. In a preferred embodiment with clockwise operation of the crank-handle or alternatively a motor, the rotational speed of the first guiding wheel 59 is greater than the rotational speed of the second guiding wheel 65. When the rotational speed of the first guiding wheel 59 is lower than the rotational speed of the second guiding wheel 65 the device must be operated counter-clockwise.

Figure 4:
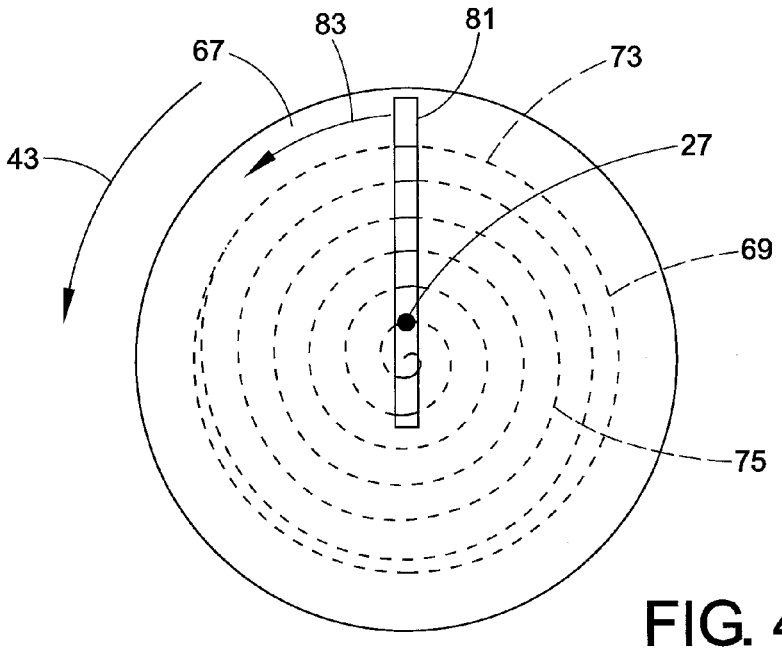
FIG. 4 shows a top view of the two guiding wheels arranged on top of each other as well as a pressure element guided by the two guiding wheels.

FIG. 4 shows the position of the pressure element 27 at the beginning of operating the device, i.e. before the end 13 of the tube 15 has been flanged. Because the radial slot 81 of the second surface 79 rotates with a different rotational speed than the guiding groove 69 of the first surface 67. The pressure element 27 is pushed at the guiding pin 71 alongside the inner helical section 75 of the guiding groove 69. As long as the guiding pin 71 moves within the inner helical section 75 the pressure element 27 is moved in the radial direction 37. In addition, the radial slot 81 is rotating, resulting in an outward helical movement of the pressure element 27 starting from an inner region of the tube 15.

The guiding pin 71 of the pressure element 27 eventually arrives at the outer circular section 73 of the guiding groove 69 and remains there until the end of the operation of the device 11. As a consequence, the movement of the pressure element 27 in the radial direction 37 is stopped as soon as the guiding pin 71 enters the circular section 73 of the guiding groove 69. Both guiding wheels 59, 65 can continue rotating although the movement of the pressure element 27 in the radial direction 37 has been stopped, i.e. the radial movement of the pressure element 27 has reached an end position.

To sum up the embodiments of the present invention described herein use the cam gear 77 comprising the guiding groove 69 and the guiding pin 71 configured for translating the rotation 43 of the first guiding wheel 59 into a movement of the pressure element 27 in the radial direction 37 until the radial end position is reached. If the radial end position has been reached, the movement is stopped but both guiding wheels 59 and 65 and therefore the driving shaft 33 can still be rotated freely. Therefore, there is no risk that the device can be damaged if a torque at the driving shaft 33 is not limited. Furthermore, the device 11 can be manufactured inexpensively because some of the mechanical parts of the device 11 are standard parts, e.g. the gears, which are typically produced in large lot sizes.

The invention claimed is:

1. A device for flanging the end of a metal tube to achieve a circumferential surface extending outward at right angles from the tube, the device comprising: a flanging tool that is attachable to the end of the metal tube, the flanging tool having a guiding arrangement comprising a rotating shaft and a pressure element having a radial end position, the guiding arrangement comprising a shifting mechanism driven by the rotating shaft that shifts the pressure element in an outward radial direction with respect to the metal tube, wherein the shifting mechanism is configured to stop shifting the pressure element if the radial end position of the pressure element is reached and permit rotation of the rotating shaft when the radial end position is reached, wherein the shifting mechanism comprises a cam gear having a first guiding wheel that comprises a guiding groove, the pressure element engaging with the guiding groove to shift the pressure element in the radial direction.

2. The device according to claim 1, wherein the guiding groove comprises an outer circular section surrounding an inner helical section of the guiding groove.

3. The device according to claim 1, wherein the pressure element has a guiding pin extending into the guiding groove so that the pressure element engages with the guiding groove.

4. The device according to claim 1, wherein the guiding arrangement comprises a rotation mechanism configured to move the pressure element in a tangential direction with respect to the tube, simultaneously shifting the pressure element in the radial direction and moving the pressure element in the tangential direction and resulting in a helical movement of the pressure element.

5. The device according to claim 4, wherein the rotation mechanism comprises a second guiding wheel having a radial slot in which the pressure element is supported shiftable in the radial direction with respect to the tube, rotating the second guiding wheel and resulting in the movement of the pressure element in the tangential direction.

6. The device according to claim 5, wherein the two guiding wheels are rotatable around a center axis and the guiding arrangement comprises a transmission configured to drive the guiding wheels via a driving shaft such that the rotational speeds of the two wheels differ from each other.

7. The device according to claim 6, wherein the rotational speed of the first guiding wheel is greater than the rotational speed of the second guiding wheel when the driving shaft is rotating.

8. The device according to claim 7, wherein the first guiding wheel and/or the second guiding wheel comprises a gear wheel.

9. The device according to claim 8, wherein a center axis of the driving shaft is located spaced apart from the center axis of the guiding wheels and running in parallel to the center axis of the guiding wheels and/or wherein the driving shaft has a first driving gear adapted to drive the first guiding wheel and a second driving gear configured to drive the second guiding wheel.

10. The device according to claim 9, wherein the transmission has a first intermediate gear located between the first driving gear and the first guiding wheel and/or a second intermediate gear located between the second driving gear and the second guiding wheel.

11. The device according to claim 10, wherein the flanging tool has a detachable crank handle attached to a shaft of the device and configured to manually drive the guiding arrangement to a further shaft of the device, wherein a transmission ratio between the further shaft and the first guiding wheel and/or the second guiding wheel is less than a transmission ratio between the driving shaft and the first guiding wheel and/or the second guiding wheel.

12. The device according to claim 11, wherein the further shaft is torque-proof connected with the first guiding wheel or the second guiding wheel.

13. The device according to claim 12, wherein the driving shaft has a coupling mechanism configured to couple an electrical drive with the driving shaft and to electrically drive the guiding arrangement, wherein the electrical drive comprises an electric screwdriver.

14. A method comprising using the device according to claim 1 for flanging the end of a metal tube.

* * * * *